US005078207A

United States Patent [19]

Asano et al.

[11] Patent Number: 5,078,207

[45] Date of Patent: Jan. 7, 1992

[54] HEAT EXCHANGER AND FIN FOR THE SAME

[75] Inventors: Kazuhiko Asano, Nagoya; Hideki Yasui, Anjo; Nobuyuki Uozumi, Nishikasugai, all of Japan

[73] Assignee: Nippondenso Co., Ltd., Kariya, Japan

[21] Appl. No.: 572,270

[22] Filed: Aug. 24, 1990

[30] Foreign Application Priority Data

Aug. 26, 1989 [JP] Japan ..... 1-220084

[51] Int. Cl.[5] ..... F28F 3/06; F28F 1/40

[52] U.S. Cl. ..... 165/166; 165/183; 138/38

[58] Field of Search ..... 165/109.1, 177, 179, 165/183, 166; 138/38

[56] References Cited

U.S. PATENT DOCUMENTS

| | | | |
|---|---|---|---|
| 2,386,159 | 10/1945 | Elder | 165/109.1 |
| 2,571,631 | 10/1951 | Trumpler | 165/166 |
| 2,656,158 | 10/1953 | Hodson et al. | 165/166 |
| 3,009,510 | 11/1961 | Meshulam | 165/183 |
| 3,528,496 | 9/1970 | Kun | 165/166 |
| 3,768,149 | 10/1973 | Swaney, Jr. | 165/166 |
| 3,783,938 | 1/1974 | Chartet | 138/38 |

FOREIGN PATENT DOCUMENTS

| | | | |
|---|---|---|---|
| 541629 | 7/1922 | France | 165/177 |
| 60-21669 | 6/1985 | Japan . | |
| 60-176379 | 11/1985 | Japan . | |
| 60-196182 | 12/1985 | Japan . | |
| 857707 | 1/1961 | United Kingdom | 165/179 |

*Primary Examiner*—John Rivell
*Assistant Examiner*—L. R. Leo
*Attorney, Agent, or Firm*—Cushman, Darby & Cushman

[57] ABSTRACT

A heat exchanger such as used as an inter cooler for cooling an intake air of an internal combustion engine has an inner fin which is provided within a tube through which heat transfer medium such as an intake air flows. The inner fin has a plurality pairs of a first vertical wall portion and a second vertical wall portions, a first horizontal wall portion connecting an upper end of the first vertical wall portion to an upper end of the second vertical wall portion, and a second horizontal wall portion connecting a lower end of the first vertical wall portion to a lower end of the second vertical wall portion. The inner fin further has a plurality of slits formed from the vertical wall portion side of the first horizontal wall portion via entire length of the vertical wall portion until the vertical wall portion side of the second horizontal wall portion. The fin pitch P, the length L of vertical wall portion between adjacent pair of the slits, and the width S of the slit are as follows.

$1.6\ mm \leqq P \leqq 2.1\ mm$ $10.0\ mm \leqq L \leqq 15.0\ mm$ $2.0\ mm \leqq S \leqq 3.0\ mm$

8 Claims, 11 Drawing Sheets

HEAT EXCHANGER AND FIN FOR THE SAME

FIELD OF THE INVENTION

The present invention relates to a heat exchanger which is used for an inter cooler for cooling intake air of an automotive engine, for example.

BACKGROUND OF THE INVENTION

An inner fin having a plurality of circular holes and being positioned within a tube for promoting the heat exchanging efficiency has been known, such as described in the Japanese laid open utility model publication 60-176379, Japanese utility model publication 60-21669.

However, since the conventional type of the inner fin also has a continuous wall on which no hole is formed, and since such the continuous wall is positioned along with a flow direction, a boundary layer is generated and grown along with the surface, as shown in FIG. 9. Such boundary layer should reduce the heat transfer efficiency (Nu). In other words, the inner fin having a circular holes cannot improve heat exchanging efficiently very effectively.

SUMMARY OF THE INVENTION

An object of the present invention is to provide a heat exchanger improving a heat exchanging efficiency.

Another object of the present invention is to provide a heat exchanger having an inner fin which can effectively broke the boundary-layer flow.

Further object of the present invention is to provide a heat exchanger having an inner fin a fin pitch P a length L of the fin, and a width S of a slit is so designed that the pressure loss of the fluid passing through the inner fin is minimized.

Still further object of the present invention is to provide a heat exchanger having an inner fin on which a plurality of slits are formed along the entire height of the fin so that the boundary-layer flow is completely broken and the local coefficient of heat transfer can be maintained in the high level.

Still further object of the present invention is to provide an inner fin a fin pitch P thereof is 1.6 mm$\leqq$P$\leqq$2.1 mm, a length of the fin L is 10.0 mm$\leqq$L$\leqq$15.0 mm and a width of the slit S is 2.0 mm$\leqq$S$\leqq$3.0 mm.

DETAILED DESCRIPTION OF THE PREFERRED EMBODIMENT

Figure 1:
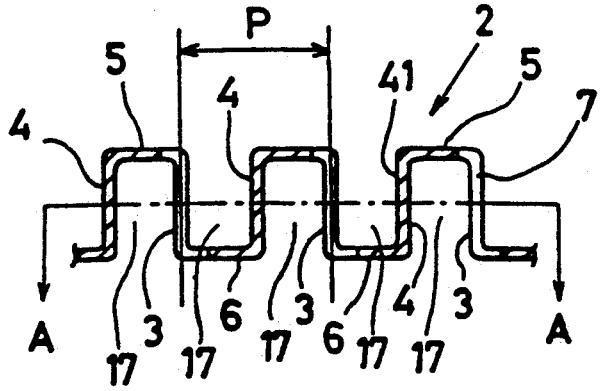
FIG. 1 is a sectional view of a fin for an inter cooler.

As shown from FIGS. 1–8, an accumulating type of inter cooler 1 is mounted at a front portion of the engine room of the automobile. The inter cooler 1 has a plurality of aluminum tubes 11 each of which is formed by a couple of aluminum plates. A cooling fin 12 is positioned between adjacent pairs of the tubes 11. One end side of the tube 11 is formed as an inlet tank 13, and another end side of the tube 11 is formed as an outlet tank 14. The inlet tank 13 is connected to a turbo charger for the automobile engine via a connector 15. The outlet tank 14 is also connected to an outlet pipe 16 through which the air passing through the inter cooler 1 is introduced from an intake manifold of the automobile engine. Each of the tube 11, the cooling fin 12, the inlet pipe 15 and the outlet pipe 16 are connected each other by brazing.

A slit fin 2 is provided within the inner side of the tube 11 for promoting the heat exchange efficiency of the intake air introduced from the turbo charger. The slit fin 2 is positioned along with the flow direction of the intake air. The slit fin 2 is connected to each of the plates of the tube 11 by brazing.

The fin pitch P of the slit fin 2 is designed between 1.6 mm and 2.1 mm, the length L of the fin 2 namely the interval between adjacent pairs of the slit is designed 10.00 mm and 15.0 mm and the width S of the slit 7 is designed between 2.0 mm and 3.0 mm.

The operation of the inter cooler 1 is explained hereinafter. A high temperature and high pressurized intake air compressed by the turbo charger is introduced into the tube 11 via the intake pipe 15 and the inlet tank 13. The intake air is cooled by the cooling air while the intake air passes through the tube 11. The intake air is then introduced into the internal combustion engine via the outlet tank 14 and the outlet pipe 16. Since the density of the air is increased when radiating mass Qg of the inter cooler is increased, the weight of the intake air passing through the inter cooler is increased in accordance with the radiating mass Qg of the inter cooler. The weight of the intake air is also increased when the pressure loss Pg of the air passing through the inter cooler 1 is reduced.

The slit fin 2 is formed by a first vertical wall portion 3, a second vertical wall portion 4, a first horizontal wall portion 5 and a second horizontal wall portion 6. These portions 3–6 are continuously provided along with the perpendicular direction of the longitudinal axis of the tube 11. The first vertical wall portion 3 and the second vertical wall portion 4 are alternatively positioned so that a plurality of fluid passes 17 are formed within the tube 11. A plurality of slits 7 are formed in the first vertical wall portion 3 by a predetermined pitch, so that a fin portion 31 and the slit 7 are positioned alternatively. A plurality of slits 8 are also formed within the second vertical wall portion 4, so that the slit 8 and a fin portion 41 are positioned alternatively. The first horizontal wall portion 5 connects the upper end of the first vertical wall portion 3 and the upper end of the second vertical wall portion 4, so that the first horizontal wall portion 5 elongates toward the perpendicular direction of the longitudinal axis of the tube 11. The upper end of the slit 7 is also formed in the first vertical wall portion 3 side of the first horizontal wall portion 5, the upper end of the slit 8 is also formed at the second vertical wall portion 4 side of the first horizontal wall portion 5. The remaining portion of the first horizontal wall portion is connected to the inner surface of the tube 11 by brazing. The second horizontal wall portion 6 is connects the lower end of the first vertical portion 3 and the lower end of the second vertical wall portion 4. The lower end of the slits 7 and 8 are also formed at the second horizontal wall portion. The remaining portion other than the slits 7 and 8 is connected to the inner surface of the tube 11 by brazing.

As described above, the slit 7 is formed in the first vertical wall portion side of the first horizontal wall portion 5, the entire length of the first vertical wall portion 3 and the first wall portion 3 side of the second horizontal wall portion 6. The slit 8 is also formed in the second vertical wall portion side of the first horizontal wall portion 5, the entire length of the second wall portion 4 and the second wall portion 4 side of the second horizontal wall portion 6. In other words, there are no portions connecting adjacent pairs of the slit portions 7 which remain in the vertical wall portions, so that each of fin portion 31 and 41 are divided perfectly.

Figure 2:
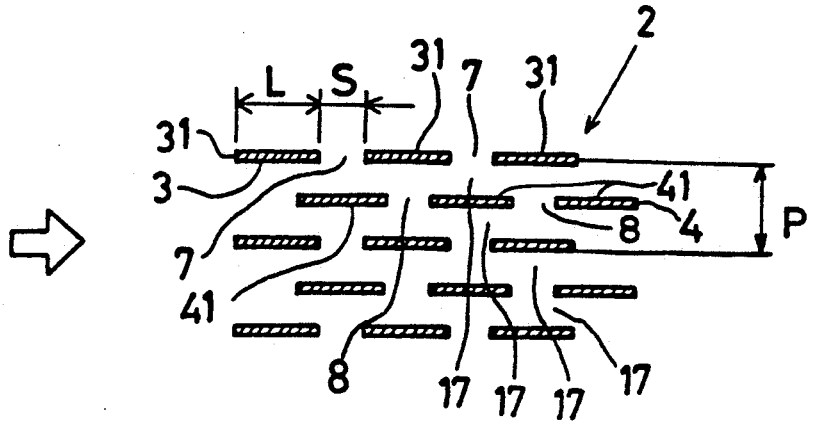
FIG. 2 is a sectional view taken along with AA line of FIG. 1.
Figure 3:
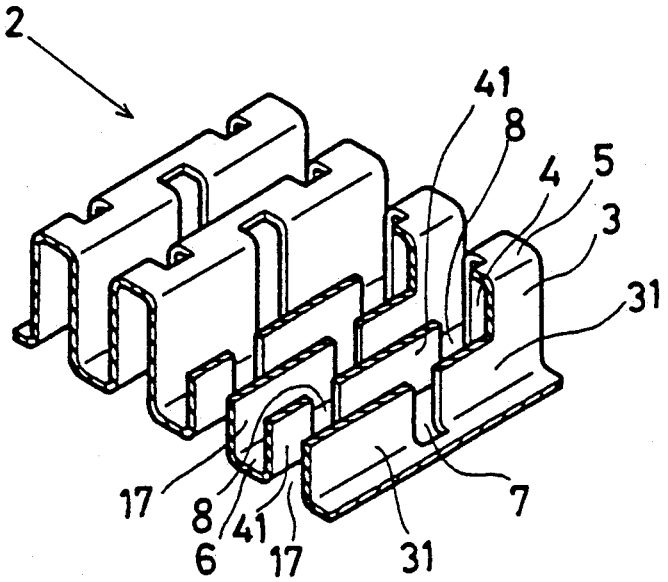
FIG. 3 is a perspective view of the fin shown in FIG. 1.
Figure 5:
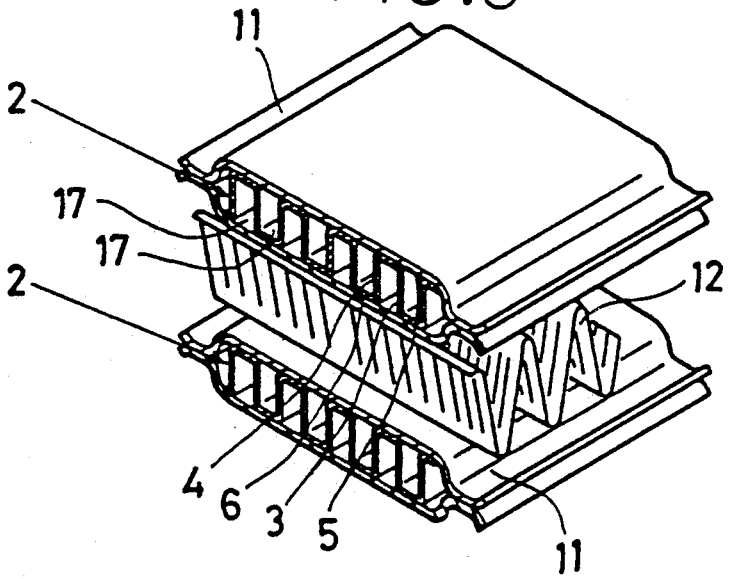
FIG. 5 is a perspective view of the sectional portion of the inter cooler shown in FIG. 4.
Figure 4:
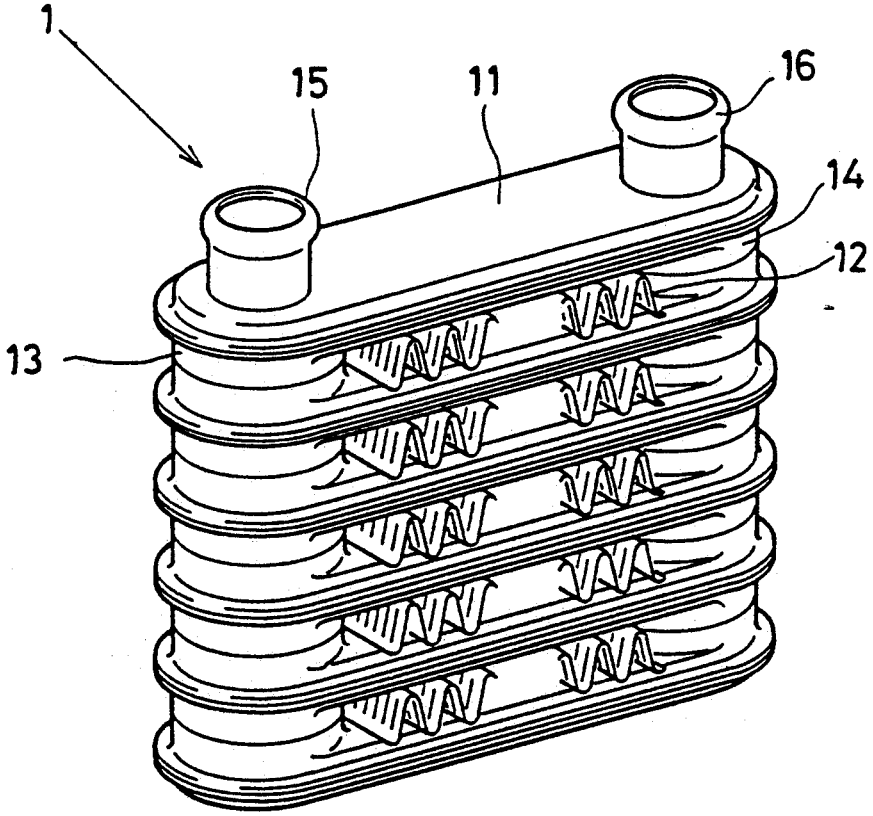
FIG. 4 is a perspective view of the inner cooler in which the fin shown in FIG. 1 is provided.

As shown from FIG. 2, the position of the slit 7 is located centered between adjacent pair of the slits 8, in other words, the slit 7 is offset from the slit 8 by $(L+S)/2$.

Figure 6:
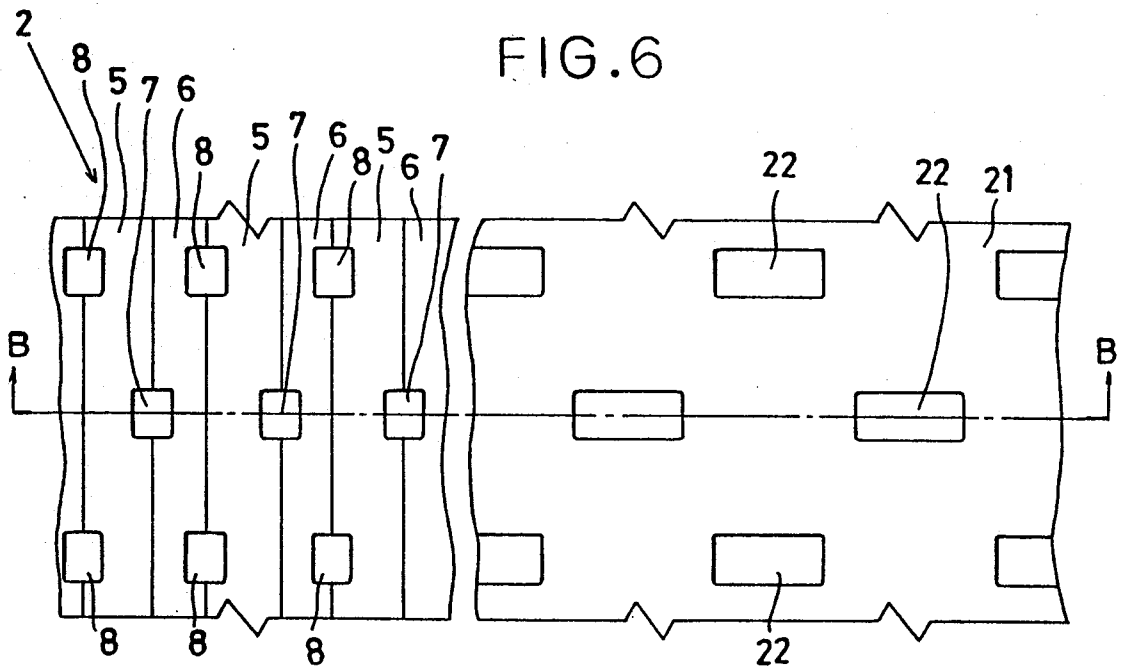
FIG. 6 is a front view of the material for the fin for explaining the forming step of the fin.
Figure 7:
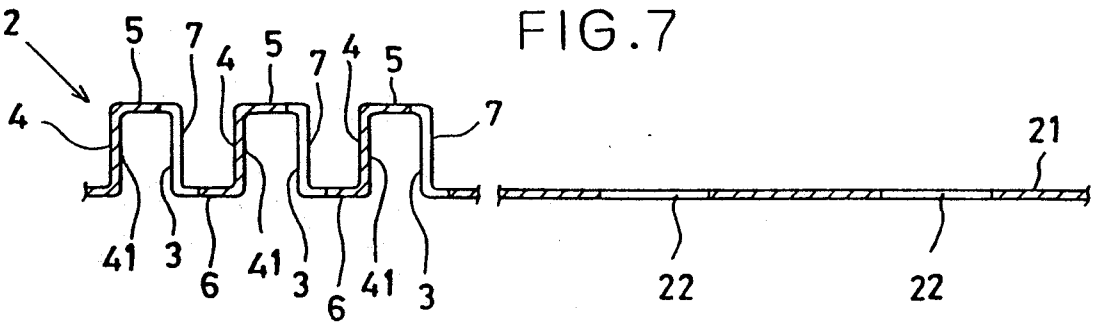
FIG. 7 is a sectional view taken along with BB line in FIG. 6.

As shown from FIGS. 6 and 7, the slit fin 2 is made of a thin plate 21 on which a plurality of square holes 22 are formed. The thin plate 21 is deformed into a serpentine shape in such a manner that the square hole 22 is positioned on the vertical wall portion.

The relationship between the dimension of each part of the fin is explained hereinafter by using the reference drawings of FIGS. 11–14. The velocity of the intake air passing through the inter cooler can be as high as 30–50 m/s. The turbulent flow generated on the downstream side of the inner fin improves the heat transfer efficiency. Such turbulent flow is produced by the slit which blocks boundary-layer flow. The present inventors have studied the relationship of the dimension between S and L. FIG. 11 explains the relationship between radiating mass ratio and the dimensions of S/L. The radiating mass ratio of this diagram is the ratio between the radiating mass Qg of the present invention and the same Qg of the conventional type offset fin 100 (described in FIG. 10). The fin pitch P of the inner fin examined is fixed as 2.7 mm. The solid line K of FIG. 11 indicates the theoretical value of the radiating mass of the slit fin the fin length of which is 2.7 mm. The circle in FIG. 11 indicates the actual measured radiating mass of the inner fin. The dot line M of FIG. 11 indicates theoretical value of the radiating mass of the inner fin the fin length L of which is 5 mm, and the triangle in FIG. 11 indicates the actual examined value. A dot line N of FIG. 11 indicates the theoretical value of the radiating mass ratio of the inner fin of the fin length L of which is 10 mm, and the square point in FIG. 11 indicates the actual examined value. The dot line O of FIG. 11 also indicates the theoretical value of the radiating mass ratio of the inner fin the fin length L of which is 20 mm, and the letter X in FIG. 11 indicates the actual examined data.

Figure 11:
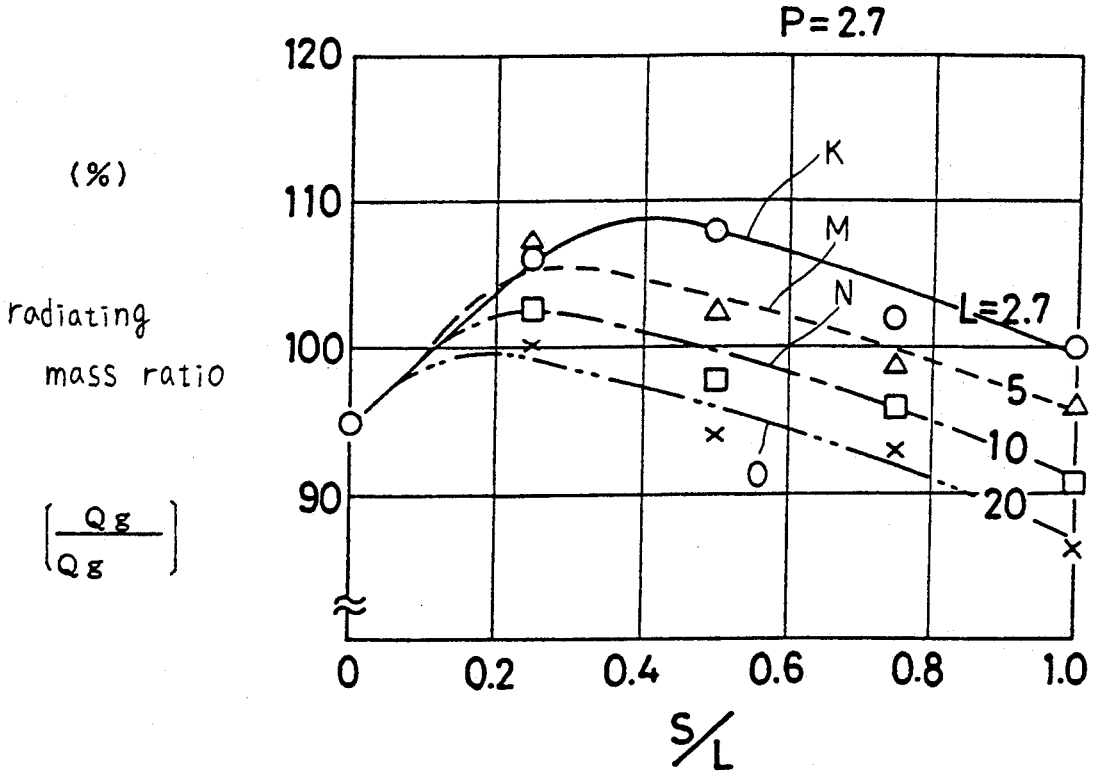
FIGS. 11 and 12 are diagrams explaining a relationship of S/L and radiating mass and pressure loss, respectively.
Figure 12:
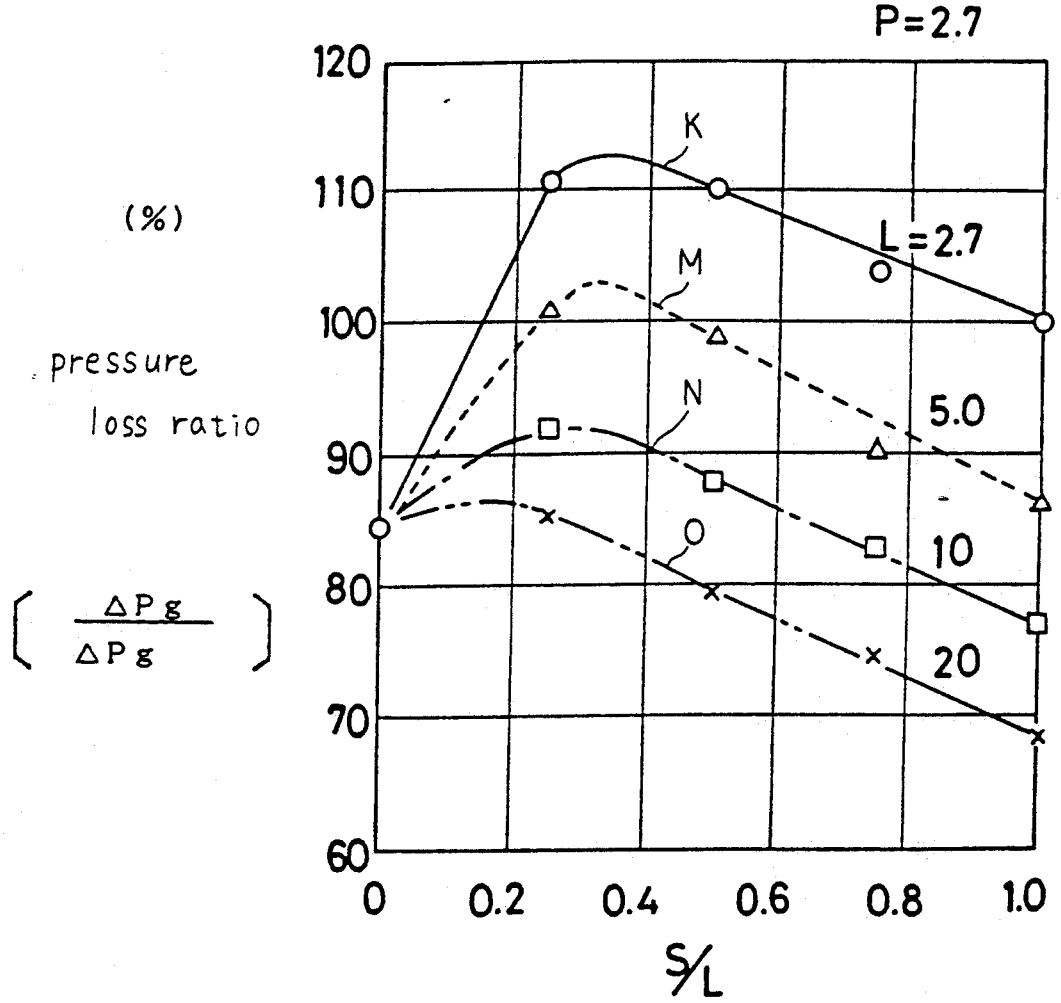

FIG. 12 explains the relationship between the pressure loss ratio and S/L. The pressure loss ratio is the ratio of a pair of pressure loss of the intake air passing through the inter coolers between a conventional type of offset fin the pitch of which is 2.7 mm (shown in FIG. 10) and the inner fin of the present invention. The lines K, M, N and O and the points of circle, triangle, square, and letter X indicate the same condition as those in FIG. 11. As shown from FIGS. 11 and 12, the radiating mass ratio and the pressure loss ratio are improved from the condition that the fin length L equal to the slit width ($S/L=1.0$) to the condition that the slit width S is smaller than the fin length L.

Since the test sample of the inner fin shown in FIGS. 11 and 12 is fixed its fin pitch P as 2.7 mm, the present inventors then have varied the fin pitch P of the inner fin in order to examine the relationship between fin pitch P, slit width S and fin length L. The diagram shown in FIG. 13 shows the relationship.

Figure 13:
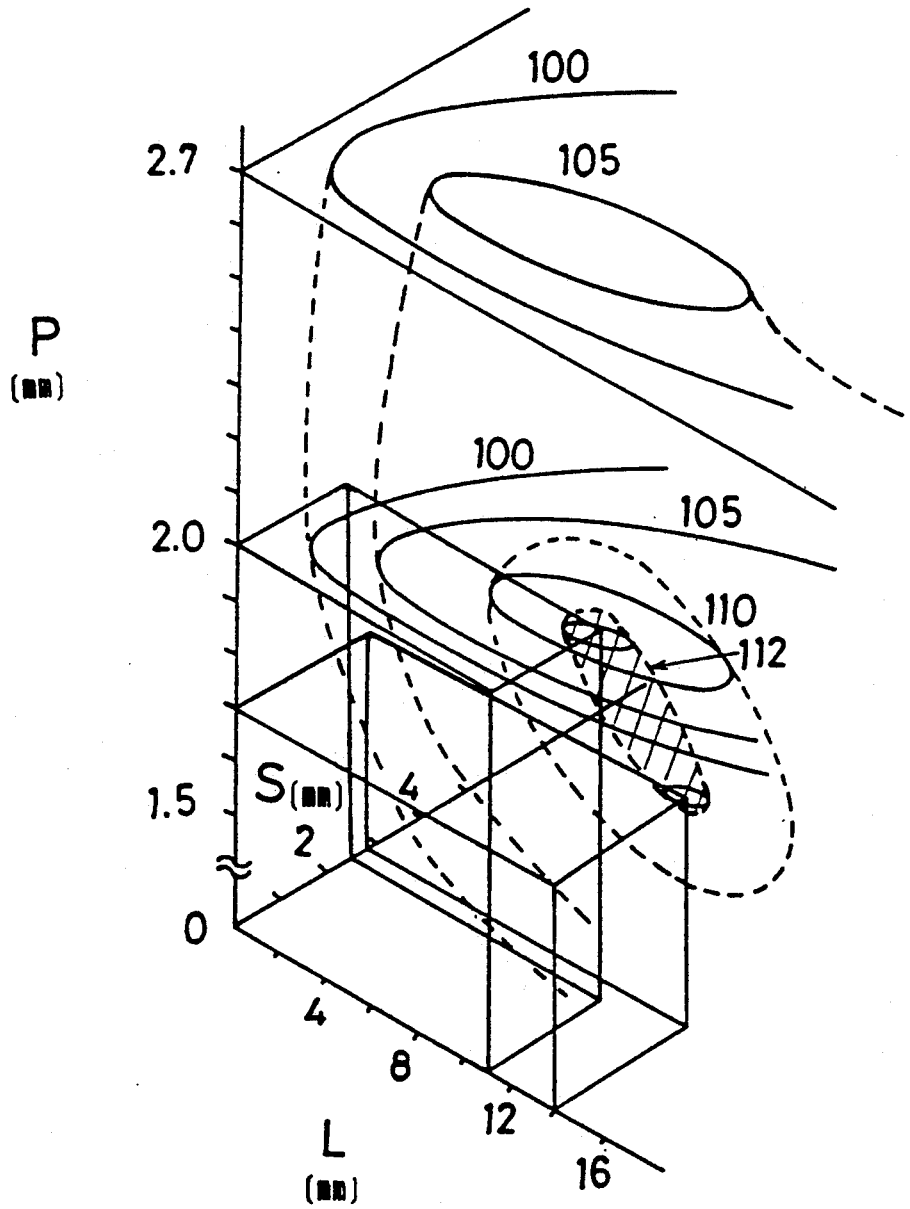
FIG. 13 is a three dimensional diagram explaining the relationship between L, P and S

The hatched area in FIG. 13 shows the dimensions of fin pitch P, slit width S and fin length L of the inner fin which can improve the radiating mass ratio as much as 112% higher than the conventional slit fin (shown in FIG. 10) while the pressure loss of the inner fin is the same as that of the conventional offset fin. As shown from this diagram, the most effective value of fin pitch P, slit width S and fin length L are, $$1.6\ \text{mm} \leqq P \leqq 2.1\ \text{mm},$$

$$10.0\ \text{mm} \leqq L \leqq 15\ \text{mm, and}$$

$$2.0\ \text{mm} \leqq S \leqq 3.0\ \text{mm}.$$

Figure 14:
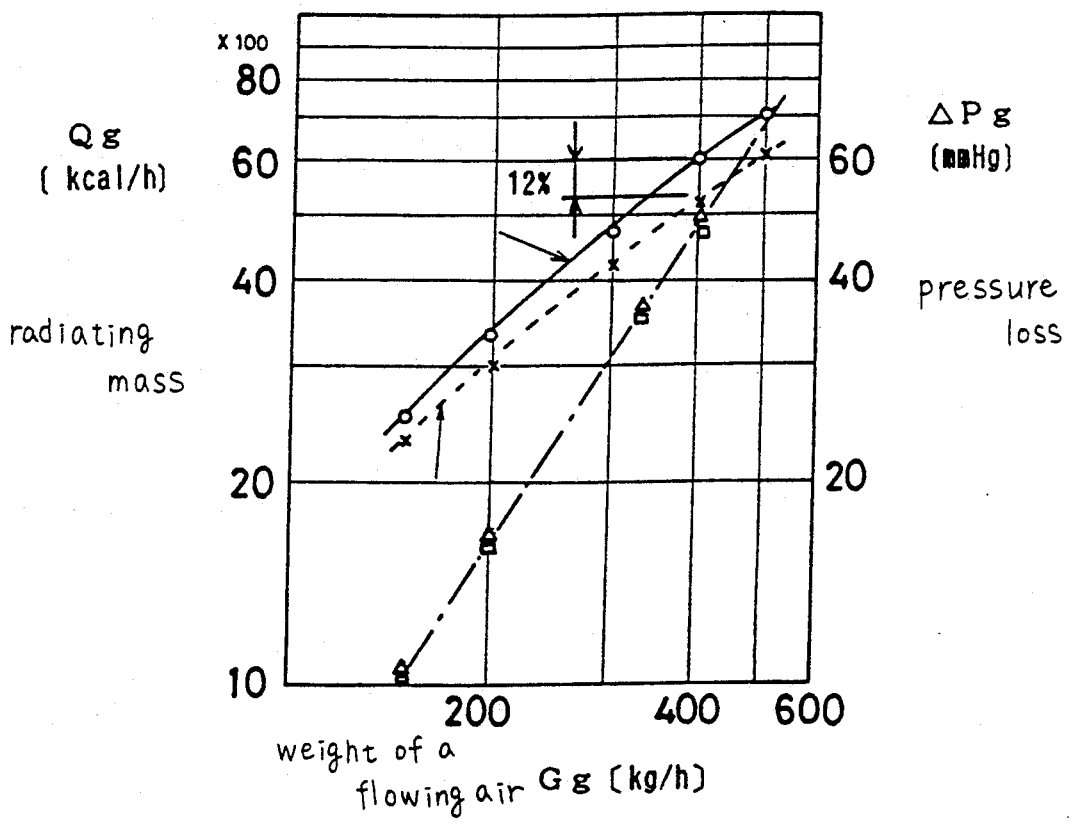
FIG. 14 is a diagram explaining a relationship between the weight of flowing air and the radiating mass and between the weight of flowing air and the pressure loss.

By using these results described above, the present inventors have made the inter cooler having the slit fin 2 the fin pitch P of which is 1.7 mm, the fin length L of which is 14 mm, the slot width S of which is 2.8 mm, and the fin height B of which is 3.8 mm. The diagram of FIG. 14 shows the relation of the radiating mass and the pressure loss between the present invention the dimensions of slit fin 2 are described above and the conventional type offset fin. The coordinate of FIG. 14 is weight ratio (Kg/h) of the intake air passing through the inter cooler. The conditions of the examination of FIG. 14 are that the temperature of the intake air at the inlet pipe is 100° C., the temperature of the cooling air is 25° C., the velocity of the cooling air is 8 m/s. The sizes of the inter cooler for examination are that the width W of which is 225 mm, the height H of which is 200 mm and the thickness D of which is 64 mm. As clearly understood from the results of the examination shown in FIG. 14, the inter cooler 1 having the slit fin of the present invention can improve the radiating mass to as much as 112% higher than that using the conventional offset fin, while the pressure loss of the intake air passing through slit fin 2 of the present invention is the same level as that of the conventional offset fin. The present inventors have also examined the difference of the conditions of the internal combustion engine using the inter coolers between the present invention and the conventional type. The examined result is described in Table 1. The inter cooler examined has the following dimension that width W of which is 225 mm, the height H of which is 200 mm and thickness of which is 64 mm.

TABLE 1

| | | |
|---|---|---|
| maximum torque point (4400 rpm) | temperature reducing ratio (%) | 116 |
| | torque increasing ratio (%) | 113 |
| maximum horse power point (6400 rpm) | temperature reducing ratio (%) | 116 |
| | horse power increasing ratio (%) | 115 |

$\left(\frac{\text{present invention}}{\text{conventional type}}\right)$

As shown from the table 1, the internal combustion engine using the inter cooler having the inner fin of the present invention can improve the maximum torque as much as 113% and the maximum horse power as much as 115%. Since the inter cooler using the slit fin of the present invention can improve the radiating mass Qg, such inter cooler can cool the high temperature intake air effectively. In other words, the inter cooler using the slit fin of the present invention can increase the density of the intake air and can increase the weight of the intake air passing through the inter cooler.

Figure 10:
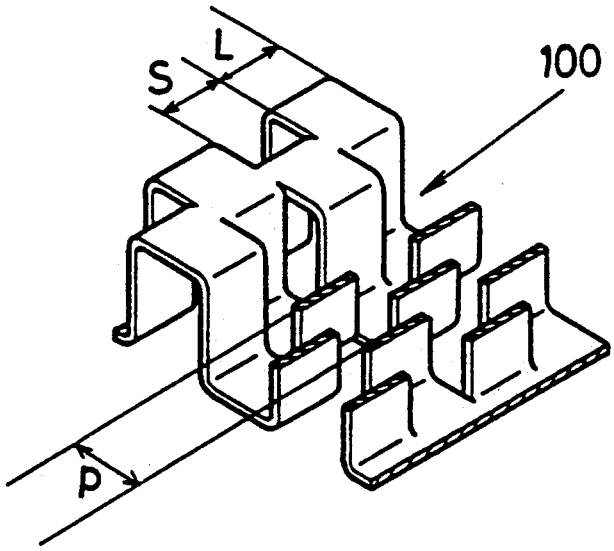
FIG. 10 (PRIOR ART)
FIG. 10 is a perspective view of a conventional offset fin.

The conventional type offset fin (L−S) shown in FIG. 10 is formed by a cutting device including a plurality of cutters. Therefore, the fin pitch P of the conventional offset fin cannot be reduced less than 2.5 mm because the cutter cannot work a long while when the width of the same is less than 2.5 mm. On the other hand, since the present slit fin is formed by bending, the fin pitch P of the inner fin of the present invention can reduce as small as about 1.7 mm. Furthermore, since the slit 7 and 8 is formed as the square hole 22 on the thin plate 21, the slit 7 and 8 is precisely formed between the first horizontal wall portion 5 and the second horizontal wall portion 6. Therefore, no remaining portion is existed on the first vertical wall portion 3 and the second vertical wall portion 4. Accordingly, the boundary-layer flow is broken by the slits 7 and 8, so that the local coefficient of heat transfer (Nu) can maintain the high volume.

As described above, the width S of the slit 7 and 8 is preferred to be smaller than the length L of the fin. Such design is suitable for the present method to form the inner fin that the hole 22 is already formed on the thin plate 21 before bending the thin plate 21.

Figure 8:
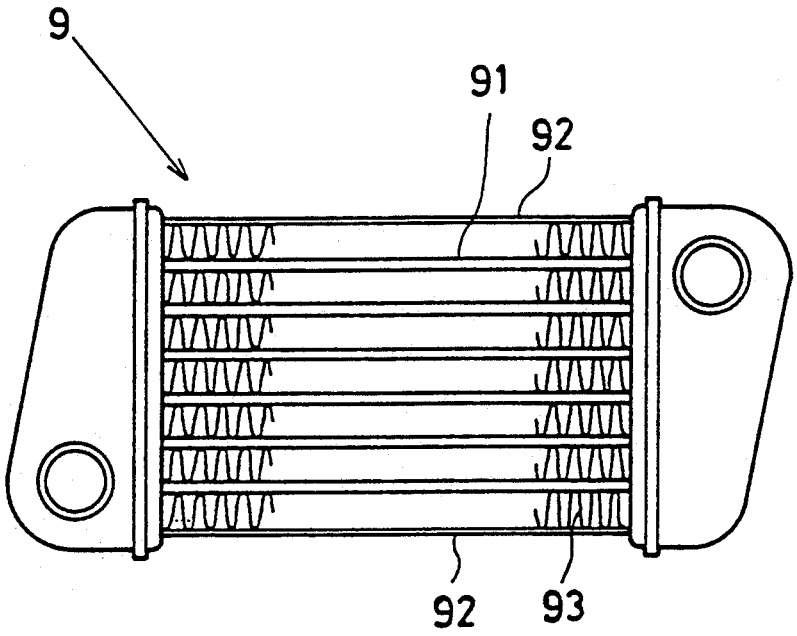
FIG. 8 is a front view of the inter cooler of the other embodiment, FIG. 9 explains the boundary layer and local coefficient of heat transfer along with the fin.
Figure 9:
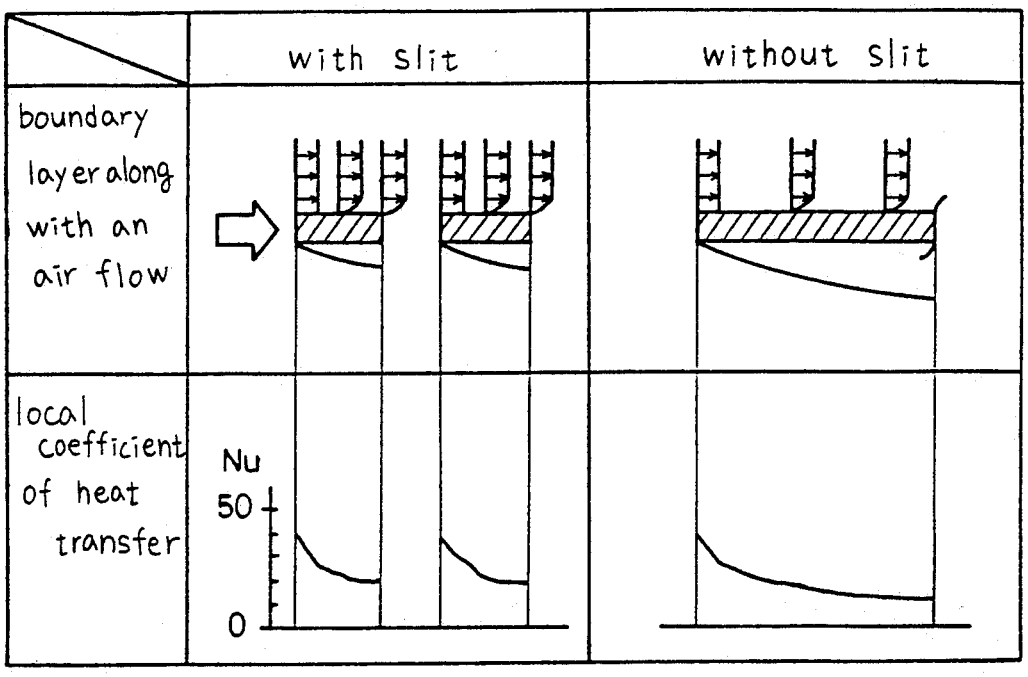

FIG. 8 shows another embodiment of the inter cooler in which the inner fin of the present invention is used. The inner cooler shown in FIG. 8 uses a plurality of flat tubes 91. The slit fin 2 of the present invention is provided within the flat tube 91. A plurality of cooling fins 93 are provided between adjacent pairs of the flat tube 91 and between the flat tube 91 and a side plate 92. Though the inter coolers shown in FIGS. 4 and 8 cool the intake air by using the air flow, a water jacket type inter cooler can also be used. The intake air is cooled by the engine coolers within the water jacket type of inter cooler.

What is claimed is:

1. A heat exchanger comprising:

a tube through which a heat transfer medium flows, an inner fin provided in said tube in such a manner that said inner fin is elongated along a flow direction of the heat transfer medium, said inner fin having a plurality of vertical wall portions which divide an inner space of said tube into a plurality of flow passages, a first horizontal wall portion extending from an upper portion of each said vertical wall portion toward an upper portion of a first adjacent vertical wall portion so that the upper portions of said each and said first adjacent vertical wall portions are connected by said first horizontal wall portion, and a second horizontal wall portion extending from a lower portion of said each vertical wall portion toward a lower portion of a second adjacent vertical wall portion so that the lower portion of said each and said second adjacent vertical wall portions are connected by said second horizontal wall portion, and said each vertical wall portion having a plurality of slits thereon, each of said slits extending between one of said first horizontal wall portions and one of said second horizontal wall portions so that said each slit extends along an entire height of said each vertical wall portion.

2. A heat exchanger claimed in claim 1, wherein said vertical wall portions are evenly spaced and a pitch P defined by a length between said first and second adjacent vertical wall portions separated by said each vertical wall portion is $$1.6\ \text{mm} \leqq P \leqq 2.1\ \text{mm}.$$

3. A heat exchanger claimed in claim 1, wherein said plurality of slits on said vertical wall portions have a predetermined pitch, so that a length L between an adjacent pair of said slits is such that $$10.0\ \text{mm} \leqq L \leqq 15.0\ \text{mm}.$$

4. A heat exchanger claimed in claim 1, wherein each said slit has a predetermined width S of $$2.0\ \text{mm} \leqq S \leqq 3.0\ \text{mm}.$$

5. A heat exchanger comprising:

an inlet tank portion in which a first heat transfer medium is introduced, an outlet tank portion through which the first heat transfer medium flows, a tube means connecting said inlet tank portion and said outlet tank portion in such a manner that the first heat transfer medium flows therethrough in a direction from said inlet tank toward said outlet tank, a cooling fin thermally connected to an outer surface of said tube means in such a manner that a second heat transfer medium flows along said cooling fin to cause heat exchange between the first heat transfer medium and the second heat transfer medium, and an inner fin provided within said tube along a flowing direction of said first heat transfer medium, said inner fin having a first wall portion and a second wall portion extending between a first side inner surface of said tube and a second side inner surface of said tube, a first connecting wall portion connecting a first end of said first wall portion to a first end of said second wall portion, and a second connecting wall portion connecting a second end of said first wall portion and a second end of a third wall portion disposed at an opposite side of said second wall portion than said first wall portion, said first connecting wall portion and said second connecting wall portion being connected to the first side inner surface of said tube and the second side of inner surface of said tube respectively, and said inner fin further including a plurality of slits, a first group of said slits extending through an entire length of said first wall portion from said first end to said second end a second group of said slits extending through an entire length of said second wall portion from said first end to said second end, and disposed at an opposite side of said second connecting wall portion with regard to said first connecting wall portion through an entire length of said second wall portion.

6. An inner fin provided within a tube through which a heat transfer medium flows, comprising:

a plurality of vertical wall portions and a plurality of horizontal wall portions connecting adjacent pairs of said vertical wall portions in a staggered pattern such that a first end of each vertical wall portion is connected to a first end of a first adjacent vertical wall portion and a second end of said each vertical wall portion is connected to a second end opposite said first end of a second adjacent vertical wall portion, a fin pitch P defined by the length between said first and second adjacent vertical wall portion of said inner fin being greater than 1.6 mm and less than 2.1 mm, said inner fin further including a plurality of slits extending along at least an entire height of said vertical wall portion in such a manner that an adjacent pair of said slits is apart from each other by a predetermined length L of $$10.0\ \text{mm} \leqq L \leqq 15.0\ \text{mm}.$$

a width S of said slit being greater than 2.0 mm and less than 3.0 mm.

7. A heat exchanger comprising:

a tube through which a heat transfer medium flows, an inner fin provided in said tube in such a manner that said inner fin is elongated along a flow direction of the heat transfer medium, said inner fin having a plurality of vertical wall portions which divide an inner space of said tube into a plurality of flow passages, a first horizontal wall portion extending from an upper portion of each vertical wall portion toward an upper portion of a first adjacent vertical wall portion so that upper portions of said each and said first adjacent pair of said vertical wall portions are connected by said first horizontal wall portion, and a second horizontal wall portion extending from a lower portion of each vertical wall portion toward a lower portion of a second adjacent vertical wall portion so that lower portions of said each and said second adjacent vertical wall portions are connected by said second horizontal wall portion, and said vertical wall portion having a plurality of slits therein, said slits extending at least an entire height of said vertical wall portion, each of said slits disposed on one of said vertical wall portions facing an adjacent one of said vertical wall portions, and spaced between two of said slits on said adjacent one of said vertical wall portions.

8. A heat exchanger as in claim 5, wherein said first group of slits are located spaced between adjacent ones of said second groups of slits with respect to a direction of flow of said first heat transfer medium.

* * * * *